United States Patent [19]

Schlechtweg

[11] Patent Number: 4,480,958

[45] Date of Patent: Nov. 6, 1984

[54] HIGH PRESSURE TURBINE ROTOR TWO-PIECE BLADE RETAINER

[75] Inventor: Ronald E. Schlechtweg, Fairfield, Ohio

[73] Assignee: The United States of America as represented by the Secretary of the Air Force, Washington, D.C.

[21] Appl. No.: 465,213

[22] Filed: Feb. 9, 1983

[51] Int. Cl.[3] ..... F01D 5/32

[52] U.S. Cl. ..... 416/220 R; 416/219 R

[58] Field of Search ..... 416/196 R, 219 R, 220, 416/221, 218, 224 A

[56] References Cited

U.S. PATENT DOCUMENTS

| | | | |
|---|---|---|---|
| 3,266,770 | 8/1966 | Harlow | 416/220 |
| 3,443,791 | 5/1969 | Sevetz et al. | 415/115 |
| 3,734,646 | 5/1973 | Perkins | 416/220 |
| 3,768,924 | 10/1973 | Corsmeier et al. | 416/220 |
| 3,814,539 | 6/1974 | Klompas | 416/95 |
| 3,832,092 | 8/1974 | Manharth | 416/220 |
| 4,102,603 | 7/1978 | Smith et al. | 416/244 |
| 4,171,930 | 10/1979 | Brisken et al. | 416/220 R |
| 4,192,633 | 3/1980 | Herzner | 416/221 |

FOREIGN PATENT DOCUMENTS

| | | | |
|---|---|---|---|
| 2324873 | 4/1977 | France | 416/220 |
| 290097 | 4/1953 | Switzerland | 415/116 |
| 779056 | 7/1957 | United Kingdom | 416/221 |

*Primary Examiner*—Henry C. Yuen
*Assistant Examiner*—John Kwon
*Attorney, Agent, or Firm*—Donald J. Singer; John R. Flanagan

[57] ABSTRACT

A blade retainer for holding a turbine blade on a turbine rotor disc and sealing a cooling cavity formed between the disc and blade has a two-piece construction. The first piece performs the blade loading function, while the second piece performs the cavity sealing function. The two pieces are attached to the disc by a common set of fasteners, such as bolts.

5 Claims, 7 Drawing Figures

HIGH PRESSURE TURBINE ROTOR TWO-PIECE BLADE RETAINER

RIGHTS OF THE GOVERNMENT

The invention described herein may be manufactured and used by or for the Government of the United States for all govenmental purposes without the payment of any royalty.

BACKGROUND OF THE INVENTION

1. Field of the Invention

The present invention broadly relates to gas turbine rotors and, more particularly, is concerned with a retainer construction for locking turbine rotor blades in the periphery of a turbine rotor disc and for sealing coolant passageways within the disc.

2. Description of the Prior Art

In a gas turbine engine, turbine blades are typically attached to a rotor disc by inserting them in axially-directed slots formed in the rim of the disc. The blades are usually held in place by a thin circular plate called a blade retainer which is attached to either or both sides of the disc by suitable fastening means such as conventional bolts. Examples of such a blade retainer are represented by the one-piece prior art designs illustrated in FIGS. 1 and 2.

In addition to holding the blades in stationary positions on the rotor disc, the retainer commonly serves two additional functions. First, it seals a cavity between the blades and the rotor disc to allow cooling air to flow to the blades with minimal leakage to the external environment. Second, it dampens vibration of the blades as a result of an axial load imparted into the blades at an area below the airfoil of each blade.

In certain high pressure turbines, these blade retainer designs have proven unacceptable for applications where long cyclic lives are required, in that, they are low cycle fatigue limited in the bolt hole region. In addition, they typically impart large loads into the rotating discs and create cyclic life problems in the disc itself. Consequently, a need exists for a blade retainer design which effectively reduces the high stresses encountered in both the disc and the retainer itself, and thereby greatly improves component cyclic life.

SUMMARY OF THE INVENTION

The present invention provides a unique two-piece construction for a blade retainer which is designed to satisfy the aforementioned needs. Underlying the present invention is the recognition that the incorporation by the prior art designs of incompatible or conflicting funtions within a one-piece blade retainer construction was the problem. These conflicting functions involved using the blade retainer for sealing the cooling cavity formed between the blades and the rotor disc, while at the same time using the blade retainer to dampen any vibration of the blades by imparting an axial load into the blades. This recognition of the problem paved the way to the solution proposed by the present invention whose elegance is augmented rather than diminished by its simplicity, low cost and reliability. The solution proposed by the present invention is to provide a two-piece design which separates these conflicting functions from one another in such a way that the functions can be carried out side-by-side without interfering with one another.

Accordingly, the present invention provides a unique two-piece construction of a blade retainer for combination with a turbine rotor disc and at least one turbine blade mounted in a peripheral rim of the disc such that a cavity is formed between the blade and the disc and open at least at one side of the disc. The blade retainer is comprised by: (a) a first blade loading piece; and (b) a second cavity sealing piece. The blade loading piece includes in serially interconnected relationship the following: (i) a first element for engaging the blade; (ii) a second element for abutting a first shoulder on the disc rim and anchoring the blade loading piece against centrifugal forces generated during rotor disc rotation; and (iii) a third element for attachment of the blade loading piece to the disc rim so as to impose a vibration-damping loading force on the blade via the first element. The second cavity sealing piece is separate from the first blade loading piece and includes the following: (i) a first member for closing the cavity at least at the one side thereof and for attachment of the cavity sealing piece to the disc rim; and (ii) a second member for anchoring the cavity sealing piece against centrifugal forces generated during rotor disc rotation. Further, the third element of the blade loading piece has defined therein spaced apart holes through which the blade loading piece may be attached to the disc rim by suitable fasteners such as bolts. Stress concentration reducing means are incorporated in the third element for relieving stress concentration in the region of the bolt holes in the blade loading piece. Such stress concentration reducing means may take the form of an intermediate set of holes defined between the bolt holes or, alternately, scallops instead of the intermediate holes.

DETAILED DESCRIPTION OF THE INVENTION

Figure 1:
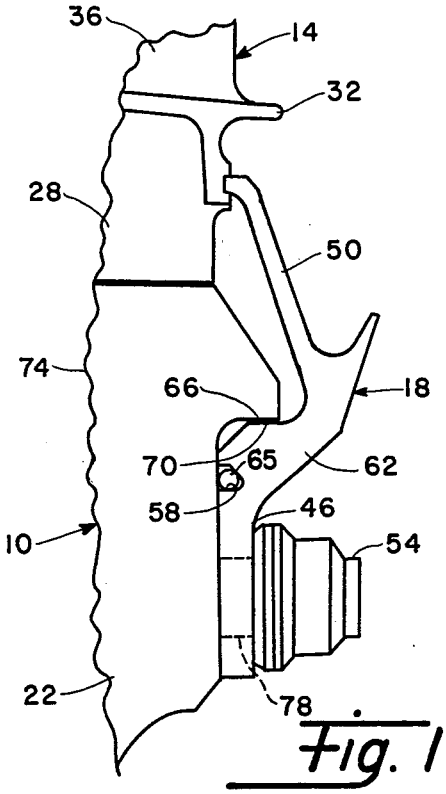
Fig. 1 Prior Art
FIG. 1 is a fragmentary side elevational view of a turbine rotor blade and disc, showing a first prior art design of a blade retainer holding the blade on the disc.
Figure 2:
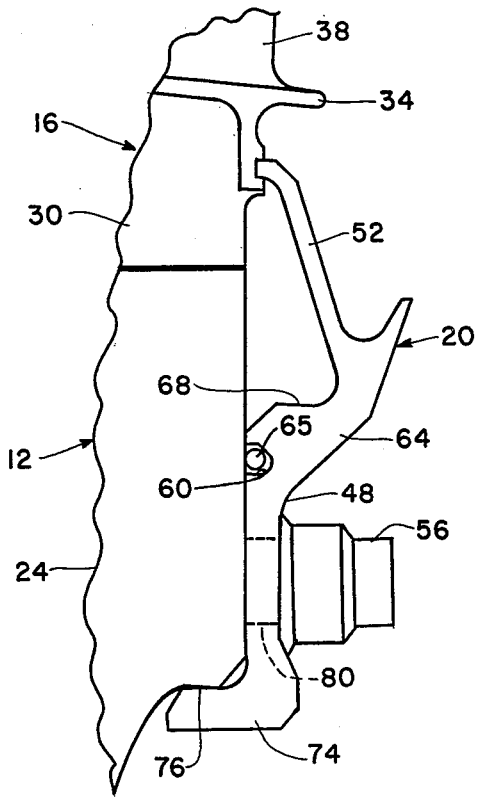
Fig. 2 Prior Art
FIG. 2 is a fragmentary side elevational view of a turbine rotor blade and disc, illustrating a second prior art design of a blade retainer holding the blade on the disc.

Referring now to the drawings, and more particularly to FIGS. 1 and 2, there are shown fragmentary portions of prior art gas turbine engines which include respective annular rotor discs 10, 12 of slightly different configurations and respective turbine blades 14, 16 mounted to each of the discs and stationarily held in place by respective prior art blade retainers 18, 20 of slightly different one-piece constructions.

Figure 4:
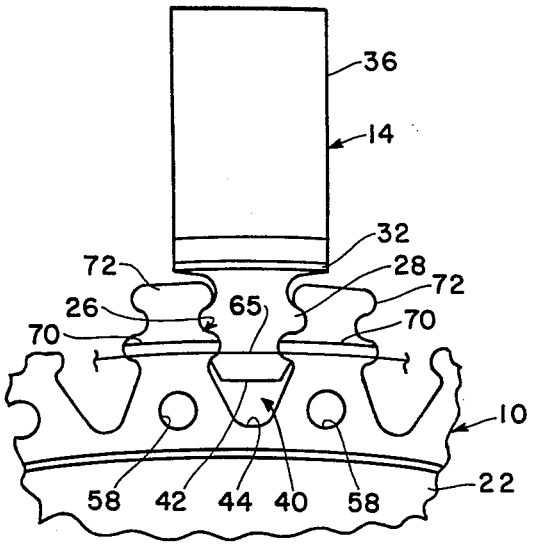
FIG. 4 is a fragmentary front elevational view showing the mounting of a turbine rotor blade onto the rotor disc and the cooling cavity formed therebetween.

The rotor discs 10, 12 have enlarged peripheral rims 22, 24 with a plurality of individual blade receiving slots or grooves 26 (see FIG. 4) extending through the peripheral rim in a generally axial direction relative to the rotor disc. The rotor blades 14, 16 are respectively made up of root portions 28, 30, platform portions 32, 34, and airfoil portions 36, 38. As seen in FIG. 4, the root portion 28 of the blade 14 is configured to be received in intermeshing fashion in one of the complementarily configured grooves 26 in the peripheral rim 22 of rotor disc 10. The blade 14 has interior passageways (not shown) which communicate with passageways (not shown) in the rotor disc 22 via a cavity 40 defined by the space between the bottom 42 of the root portion 28 and the lower wall portion 44 of the channel 26. Suitable cooling fluid is flowed to the blade interior through these passageways and cavity 40 for maintaining the blades below a desired temperature. Similar interior passageways and cavities are present in disc 12 and blade 16 but not shown in the drawings.

The blades 14, 16 are held in place on the corresponding rotor discs 10, 12 by respective blade retainers 18, 20 which take the form of thin circular or annular-shaped plates. The retainers 18, 20 include sealing portions 46, 48 and loading portions 50, 52. The sealing and loading portions are integrally connected together and formed by any suitable method, such as by machining from a common forging to provide a rigid one-piece construction. Both retainers 18, 20 are attached to enlarged rims 22, 24 on respective discs 10, 12 at either or both sides thereof by a plurality of bolts 54, 56 (only one of which is shown for each respective retainer in FIGS. 1 and 2). Holes 58 defined in rim 22 of disc 10 for receiving bolts 54 are shown in FIG. 4.

Sealing portions 46, 48 of respective retainers 18, 20 seal either or both ends of the cavity 40 formed between the blades 14, 16 and the discs 10, 12 so as to facilitate the flow of cooling fluid, such as air, through the discs to the blades with minimal leakage to the external environment. Loading portions 50, 52 of respective retainers 18, 20 impart an axial load into the blades at their root portions 28, 30 for dampening any vibration which may be induced into the blades during operation of the turbine engines.

Both retainers 18, 20 employ a wire seal cavity 58, 60 at the junctures 62, 64 between the respective sealing and loading portions thereof. The purpose of the wire seal cavities 58, 60 is to provide a cavity for circumferential wire 65 to assist in sealing the cavity formed by the rounded edges on the root portions of the blades 28, 30 and the grooves 26 in the disc posts 72. The wire seal 65 also provides sealing to the gap established by slight axial thickness variations between the disc post 72 and the root portions of the blades 28, 30. Also, recessed shoulders 66, 68 are defined at the respective junctures 62, 64.

It will also be noted that the prior art retainers 18, 20 of FIGS. 1 and 2, respectively, have slightly different designs. This adapts them to be applied to rotor discs 10, 12 which have slightly different designs. The recessed shoulder 66 of retainer 18 is utilized for anchoring it on the disc 10, while the recessed shoulder 68 of retainer 20 is not so utilized. The rotor disc 10 has a protruding ledge 70 on its outer post portions 72 (see FIG. 4) under which recessed shoulder 66 of retainer 18 is disposed. The rotor disc 12 has no such ledge. Instead, the sealing portion 52 of retainer 20 has an integrally attached hook 74 which is disposed under a lower edge 76 of the rim 24 of rotor disc 12 for anchoring the retainer 20 to the disc 12. No comparable hook feature is present on sealing portion 46 of retainer 18.

The prior art retainers 18, 20 have proven unacceptable for applications where long cyclic stress lives are required. Due to their one-piece constructions, which combines the sealing and loading functions into a single integrally formed part, severe cyclic stress problems occur in the regions of discs where the respective retainers are anchored and in the regions of the retainer bolt holes 78, 80 through the sealing portions 46, 48 of the retainers. In the case of retainer 18, the cyclic life problem due to loading occurs in the region of the shoulder 70 on the disc post 74 since the entire load of the retainer 18 is carried at that region. In the case of retainer 20, the cyclic life problem due to loading occurs in the region of the lower edge 76 of rim 24 of disc 12 and in the retainer hook 74 itself. Loading forces in these regions of the discs and retainers are created by radially-directed centrifugal forces which arise upon rotation of the rotor discs during operation of the turbine engines.

Figure 3:
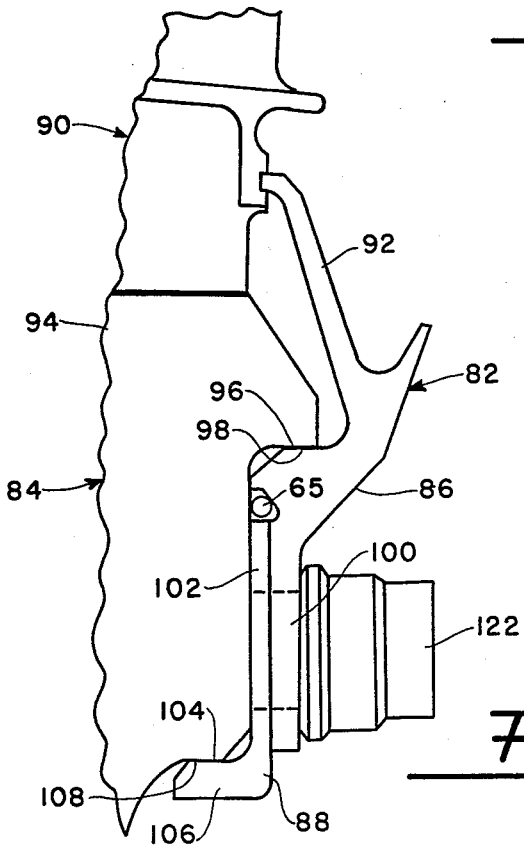
FIG. 3 is a fragmentary side elevational view of a turbine rotor blade and disc, depicting the unique two-piece blade retainer design of the present invention holding the blade on the disc.
Figure 5:
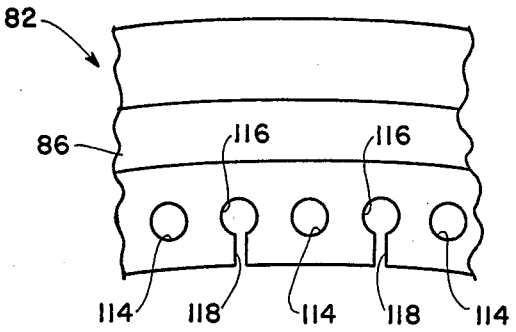
FIG. 5 is a fragmentary front elevational view of the damping portion of the two-piece blade retainer of FIG. 3.
Figure 6:
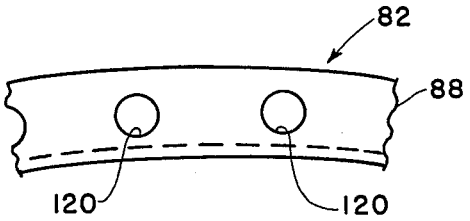
FIG. 6 is a fragmentary front elevational view of the sealing portion of the two-piece blade retainer of FIG. 3.

The unique two-piece construction for the blade retainer of the present invention is shown in FIGS. 3, 5 and 6, and is generally designated 82. This retainer design effectively reduces the high stresses encountered in both the rotor disc 84 and the retainer itself, and consequently greatly improves component cyclic life.

The blade retainer 82, as seen in FIG. 3, is comprised by a separate first blade loading piece 86 and a separate second cavity sealing piece 88. The blade loading piece 86 now holds and dampens the blade 90, while the separate cavity sealing piece 88 seals or closes the cavity (same as seen in FIG. 4) between the disc 84 and blade 90.

The first blade loading piece 86 includes, in interconnected serial relationship, a first element 92 for engaging the blade 90 in order to impart an axial load required for vibration dampening, a second element 96 for abutting a protruding shoulder or ledge 98 on the disc rim 94 and thereby anchoring the first piece 89 against centrifugal forces generated during rotation of the rotor disc 84, and a third element 100 for attachment of the first piece 86 to the disc rim 94 so as to impose a vibration-dampening loading force on the blade 90 through the first element 92.

Figure 7:
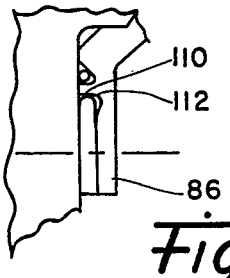
FIG. 7 is a fragmentary side elevational view of a two-piece blade retainer which is an alternative to the one depicted in FIG. 3.

The second cavity sealing piece 88 which is separate from the first blade loading piece 86 includes, in interconnected serial relationship, a first member 102 for closing the cavity at the side of the disc 84 and for attachment of the second piece 88 to the disc rim 94, and a second member 104 anchoring the second piece 88 against centrifugal forces generated during rotation of rotor disc 84. The second member 104 may take the form of a hook 106, as seen in FIG. 3, for extending under and abutting a lower edge or shoulder 108 of the disc rim 94. Alternatively, the second member may take the form of an end shoulder 110 which abuts a shoulder 112 on the first piece 86, such as seen in FIG. 7.

Since the first blade loading piece 86 of the retainer 82 is now relieved of the cavity sealing function, the area between a first set of bolt holes 114 (FIG. 5) may be stress relieved by a second intermediate set of holes 116, or, alternatively, by scallops 118, which are shown in combination with the second set of holes 116 in FIG. 5. This allows a reduction in bolt hole stress concentration and consequently greatly improves component life. Such stress relieving is not possible in the prior art retainer designs of FIGS. 1 and 2 since such would permit large amounts of blade cooling air leakage.

As seen in FIG. 3, the first member 102 of the cavity sealing piece 88 is overlapped by the third element 100 of the blade loading piece 86. Also, the first member 102 of second piece 88 includes a set of bolt holes 120 which align with those holes 114 of the third element 100 of first piece 86 when the two pieces are positioned for attachment to the disc rim 94 by bolts 122.

It will now be realized that the preferred two-piece design of retainer 82 in FIG. 3 allows the radial load of the retainer to be carried in two separate areas on the rotor disc. The retainer itself is now lighter due to the reduction in weight of the retainer 82 over the previous designs in the bolt hole region by the removal of material due to the introduction of the intermediate stress-reducing holes. This reduction of weight reduces the load imparted into the disc and consequently the cyclic life of the disc posts are improved over the prior designs. Further, the radial load of piece 88 imparted to the disc 84 is small due to the light weight of piece 88. Consequently, a cyclic life problem in the rim area due to the seal function is eliminated in the retainer 82.

The second cavity sealing piece 88 is entrapped by the disc ledge 98 at the top and by the first piece 86 and bolts 122 on the outer side. Furthermore, the hook 106 on the second piece 88 is designed to have a long cyclic life. The rigid entrapment of the second piece 88 reduces the consequence of any failure. It can then be classified as non-critical since any failure is expected to be adequately contained.

In summary, this improved two-piece design of the retainer 82 "divides" the functions performed by previous blade retainers and allows them to be performed side-by-side without interference with one another by separate components. However, this unexpectedly alleviates cyclic life problems in both the disc and retainer. The sealing piece 88 may have the potential for a low cyclic life but is a non-critical part as a result of the retainer construction.

It is thought that the two-piece blade retainer of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having described the invention, what is claimed is:

1. In combination with a turbine rotor disc and at least one turbine blade mounted in a peripheral rim of said disc such that a cavity is formed between said blade and said disc and opens at least at one side thereof, a blade retainer, comprising:

(a) a first blade loading piece including in serially interconnected relationship:

(i) a first element engaging said blade, (ii) a second element abutting a first shoulder on said disc rim and anchoring said blade loading piece against centrifugal forces generated during rotor disc rotation, and (iii) a third element for attachment of said blade loading piece to said disc rim so as to impose a vibration-dampening load force on said blade via said first element;

(b) a second cavity sealing piece separate from said first piece and including in serially interconnected relationship:

(i) a first member closing said cavity at least at said one side thereof and for attachment of said cavity sealing piece to said rim, and (ii) a second member anchoring said cavity sealing piece against centrifugal forces generated during rotor disc rotation;

(c) said third element of said first piece and said first member of said second piece being disposed in an overlapped relationship for attachment to said disc rim, said first member of said second piece being disposed adjacent said disc rim and said third element of said first piece being spaced from said disc rim; and (d) common fastening means connecting both said first member of said second piece and third element of said first piece together and attaching the same in said overlapped relationship to said disc rim;

(e) said third element of said first piece further having defined therein a first set of spaced apart holes through which said first piece may be attached to said disc rim by said common fastening means, and stress concentration reducing means for relieving stress concentration in the region of said holes.

2. The blade retainer as recited in claim 1, wherein said second member of said second piece includes a shoulder for abutting a second shoulder on said disc rim.

3. The blade retainer as recited in claim 1, wherein said second member of said second piece includes an end shoulder for abutting said first piece.

4. The blade retainer as recited in claim 1, wherein said stress concentration reducing means take the form of a second set of holes defined between said first set of holes.

5. The blade retainer as recited in claim 1, wherein said stress concentration reducing means take the form of a set of scallops defined between said first set of holes.

* * * * *